United States Patent [19]

Habu

[11] 4,058,095

[45] Nov. 15, 1977

[54] DISTRIBUTOR FOR AN INTERNAL COMBUSTION ENGINE

[75] Inventor: Nobuo Habu, Shizuoka, Japan

[73] Assignee: Toyota Jidosha Kogyo Kabushiki Kaisha, Toyota, Japan

[21] Appl. No.: 694,931

[22] Filed: June 11, 1976

[30] Foreign Application Priority Data

Dec. 5, 1975 Japan ..... 50-164916[U]

[51] Int. Cl.[2] ..... F02P 5/04

[52] U.S. Cl. ..... 123/117 R; 64/25

[58] Field of Search ..... 123/117 R, 146.5 A, 123/139 AP; 64/25

[56] References Cited

U.S. PATENT DOCUMENTS 3,658,039 4/1972 Rossel ..... 123/117 R

*Primary Examiner*—Ronald B. Cox

*Attorney, Agent, or Firm*—Stevens, Davis, Miller & Mosher

[57] ABSTRACT

A distributor for an internal combustion engine which changes the ignition timing of the engine based on two variables including the rotating speed of the engine and the load imparted to the engine. A sleeve is loosely mounted on a rotary shaft of the distributor, and an ignition changing timing cam is loosely fitted on the sleeve to be rotatable around the axis of the shaft with the sleeve and movable in the axial direction of the shaft relative to the sleeve. A pair of centrifuzed weights urges the cam in the axial direction in response to the speed of the engine. A first link mechanism has at one end a follower of the cam and at the other end is connected to a breaker plate for the distributor contacts to rotate the plate and thereby change the ignition timing in response to engine speed. A second link mechanism is connected at one end to the sleeve and at the other end to a diaphragm actuator which responds to the load on the engine. The second link mechanism thereby rotates the sleeve and cam to change the ignition timing in response to engine load.

10 Claims, 2 Drawing Figures

DISTRIBUTOR FOR AN INTERNAL COMBUSTION ENGINE

BACKGROUND OF THE INVENTION

1. Field of the Invention

This invention relates to distributors, and more particularly to an improved distributor for an internal combustion engine in which means are provided for changing the ignition timing depending on variations in the two variables, i.e., the rotating speed of the engine and the load imparted to the engine, so as to minimize the amount of noxious components contained in engine exhaust gases.

2. Description of the Prior Art

There are various methods for reducing the amount of noxious components contained in gases exhausted from internal combustion engines of the spark ignition type. Among these methods, the method of changing the ignition timing depending on the operating condition of the engine is most preferable in that it can effectively reduce the noxious components and it can be most simply put into practical use. Therefore, a suitable ignition timing controller based on this method is desirably used for the engine of this type so that the ignition timing can be changed as desired depending on the operating condition of the engine.

A distributor is commonly known as one form of ignition timing controller heretofore used for the engine of the type above described. This known distributor is generally provided with a centrifugally-actuated ignition advancing unit capable of advancing the ignition timing in proportion to the rotating speed of the engine, and the distributor is also generally connected to a vacuum-actuated ignition advancing unit capable of advancing the ignition timing in inverse proportion to the magnitude of the load imparted to the engine and hence the value of the absolute pressure appearing at the advance port of the carburetor. Although these ignition advancing units in the known distributor are useful means capable of changing the ignition timing depending on the operating condition of the engine in a certain sense, these known ignition advancing units are not fully reliable and effective in reducing the amount of noxious components contained in engine exhaust gases inasmuch as they serve merely to change the ignition timing linearly to the rotational speed of the engine and engine load relative to the standard ignition timing.

SUMMARY OF THE INVENTION

It is therefore a primary object of the present invention to provide an improved distributor for an internal combustion engine which can be controlled for advancing or retarding the ignition timing as desired relative to the standard ignition timing depending on the operating condition of the engine, thereby minimizing the amount of noxious components contained in the engine exhaust gases and reducing fuel consumption.

DESCRIPTION OF THE PREFERRED EMBODIMENT

Figure 1:
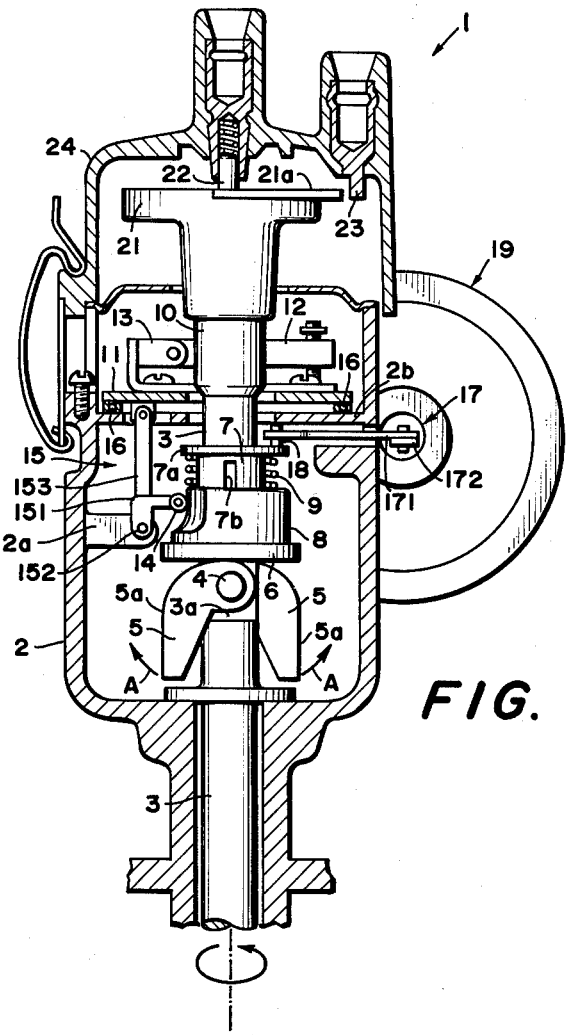
FIG. 1 is a schematic longitudinal sectional view of a preferred embodiment of the distributor according to the present invention.

With reference to FIG. 1 showing a preferred embodiment of the distributor structure according to the present invention, the distributor is designated generally by the reference numeral 1 and comprises a cylindrical housing 2 fixedly mounted to a stationary part such as the cylinder block of an internal combustion engine of the spark ignition type (not shown). A rotary shaft 3 driven from the valve cam shaft or crankshaft (not shown) of the engine extends into the cylindrical housing 2. A pair of flat portions 3*a* are formed on a part of the outer peripheral surface of the rotary shaft 3 within the housing 2 to extend in parallel with the axis of the rotary shaft 3 (although only one of these flat portions 3*a* is shown in FIG. 1). A pin 4 extending through the rotary shaft 3 normal to the axis of the rotary shaft 3 protrudes from these flat portions 3*a*, and a pair of centrifugal weights 5 of symmetrical shape are mounted for swinging movement on the protruding end portions of the pin 4. The centrifugal weights 5 have a curved upper or outer surface 5*a* providing a cam surface of predetermined configuration which is designed so that the position of a cam, described below, can be shifted along the axis of the rotary shaft 3 according to a predetermined program with an increase in the rotating speed of the rotary shaft 3. These centrifugal weights 5 are held stationary with their free end directed vertically downward as seen in FIG. 1 when the rotary shaft 3 is not rotated. However, when the rotary shaft 3 is rotated, these weights 5 are centrifugally urged to swing around the pin 4 in directions as shown by the arrows A in FIGS. 1 and 2. Thus, these weights 5 act as means for sensing the rotating speed of the rotary shaft 3, and the function thereof is similar to that of known centrifugal governors.

Figure 2:
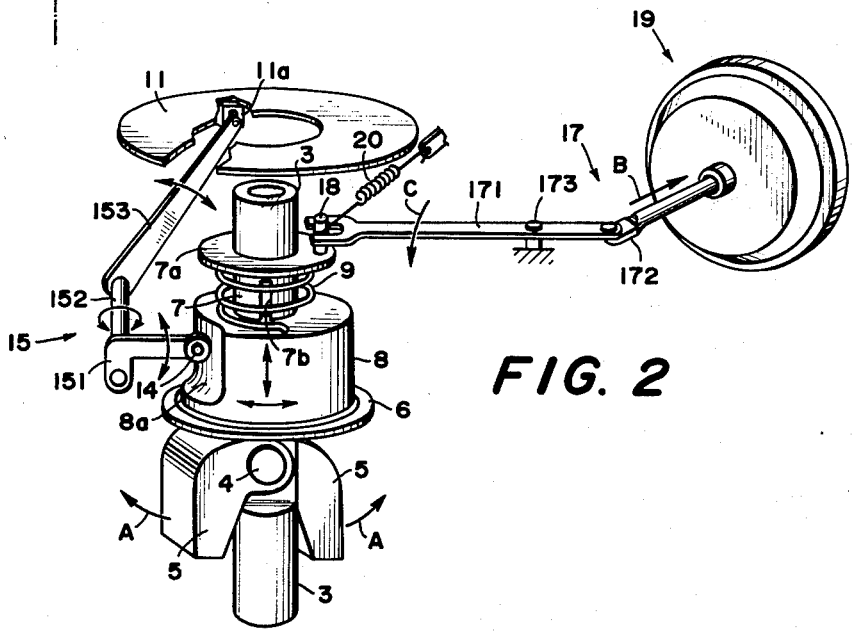
FIG. 2 is a perspective view of part of the distributor structure shown in FIG. 1.

Referring to FIGS. 1 and 2, a thrust bearing 6 is loosely mounted on the rotary shaft 3 at a position above the weights 5 and rests on the weights 5. A sleeve 7 having a flange 7*a* is loosely mounted on the rotary shaft 3 at a position above the thrust bearing 6 and is seated on the thrust bearing 6. An ignition timing changing cam 8 is loosely fitted on the sleeve 7 and has an outer peripheral cam surface 8*a* in the form of a surface of three dimensional curvature. This cam 8 is permitted to move merely in the axial direction of the rotary shaft 3 relative to the sleeve 7 and is also bodily supported on the thrust bearing 6. An axially extending key-like lug (not shown) is formed on the inner peripheral surface of the cam 8, and an axially extending slot 7*b* is formed on the outer peripheral surface of the sleeve 7 to receive the key-like lug therein, so that the cam 8 can rotate around the axis of the rotary shaft 3 together with the sleeve 7. A coil spring 9 is interposed between the flange portion 7*a* of the sleeve 7 and the upper end of the cam 8 to press the cam 8 against the thrust bearing 6 thereby positioning the cam 8 relative to the sleeve 7 mounted on the rotary shaft 3.

A contact breaker cam 10 is mounted on the rotary shaft 3 at a position above the sleeve 7, and a swinging arm 12 carrying a movable contact is supported together with a stationary contact 13 on an annular breaker plate 11 associated with the cam 10. This cam 10 is formed on the outer periphery thereof with as many lobes as the engine has cylinders, as in known distributors, and the lobed outer periphery of the cam 10 is engaged by the movable contact carried by the swinging arm 12. The swinging arm 12 carrying the movable contact is pivoted to the breaker plate 11 so as to be swingable around an axis parallel with the axis of the rotary shaft 3. The movable contact carried by the swinging arm 12 is brought abruptly into contact with the stationary contact 13 to complete the ignition circuit each time it is disengaged from one of the lobes formed on the outer periphery of the cam 10.

A follower 14 is mounted on one end of a bell crank 151 of a link mechanism 15 to engage the cam surface 8*a* of the ignition timing changing cam 8 to be moved while following the cam surface pattern of the cam 8. The bell crank 151 is fixed at the other end thereof to one end of a rod 152 which is journaled rotatably in a bearing portion 2*a* of the housing 2. The other end of the rod 152 is fixed to one end of a lever 153 which is pivoted at the other end thereof to a lug 11*a* projecting from the breaker plate 11. Thus, the link mechanism 15 composed of the bell crank 151, rod 152 and lever 153 acts to rotate the breaker plate 11 around the axis of the rotary shaft 3 depending on the movement of the cam follower 14.

A bearing 16 is mounted on an annular supporting portion 2*b* formed within the housing 2, and the breaker plate 11 is supported rotatably on this supporting portion 2*b*.

The cam 8, which is adapted to be urged in the axial direction of the rotary shaft 3 by the centrifugal weights 5, is also adapted to be rotated around the axis of the rotary shaft 3 by a second link mechanism 17. This second link mechanism 17 is composed of a lever 171 engaged at one end thereof by a pin 18 projecting from the flange portion 7*a* of the sleeve 7, and a rod 172 pivoted at one end thereof to the other end of the lever 171. The lever 171 is pivoted at an intermediate portion thereof to a stationary part such as a portion of the housing 2 by a pin 173. The other end of the rod 172 is connected to a member 19 which is adapted to axially move rod 172 by an amount corresponding to the magnitude of the load on the engine. In the preferred embodiment of the present invention shown in FIGS. 1 and 2, this member is in the form of a diaphragm actuator 19 having entirely the same structure as that employed in vacuum-actuated ignition advancing means connected to known distributors. However, this member 19 may be an accelerating rod connected to the accelerator pedal of the vehicle in lieu of such diaphragm actuator.

The diaphragm actuator designated generally by the reference numeral 19 in FIGS. 1 and 2 comprises thereinside a pair of chambers partitioned by a diaphragm. A diaphragm spring is disposed in one of the chambers to urge normally the diaphragm in one direction, while a vacuum admission pipe (not shown) is connected to the other chamber to admit therein the vacuum appearing at the advance port of the carburetor. (A detailed description will be unnecessary since the structure of these parts is entirely the same as that of known diaphragm actuators).

The other end of the rod 172 in the second link mechanism 17 is fixedly connected to the center of the diaphragm in the diaphragm actuator 19, and, therefore, the sleeve 7 in the distributor is mechanically connected by the second link mechanism 17 to the diaphragm in the diphragm actuator 19.

In order that the ignition timing can be maintained constant when the engine is not accelerated, a tension spring 20 is anchored at one end thereof to the pin 18 fixed to the flange portion 7*a* of the sleeve 7 and at the other end thereof to a suitable portion of the inner wall surface of the housing 2 as shown in FIG. 2.

A rotor head 21 of known structure is mounted on the rotary shaft 3 with the lower end thereof in contact with the upper end of the contact breaker cam 10 and is adapted for rotation together with the rotary shaft 3. A cap 24 of known structure is mounted atop the housing 2, and a center brush 22 of carbon black, in electrical contact with the center of the rotor head 21, and a side plug 23, disposed in slightly spaced apart relation from an electrode 21*a* on the rotor head 21, are carried in the usual manner by the cap 24.

The distributor of the present invention having the aforementioned structure operates in a manner as described below.

In the case in which the spark ignition engine equipped with the distributor according to the present invention is driven at a relatively high speed and a relatively heavy load is imparted to the engine, the rotary shaft 3 in the distributor is also rotated at a relatively high speed. The centrifugal weights 5 thus are swung around the pin 4 in the directions of the arrows A from the position shown in FIGS. 1 and 2. In this case, the value of intake manifold vacuum admitted into the diaphragm actuator 19 is very small, and the second link mechanism 17 is not effective in causing appreciable rotation of the sleeve 7. As a result, the thrust bearing 6 is raised along the rotary shaft 3 by the centrifugal weights 5, and at the same time, the ignition timing changing cam 8 is also raised by the thrust bearing 6 against the force of the coil spring 9. At this time, the sleeve 7 is still held stationary relative to the cam 8 although the cam 8 is raised.

With the upward movement of the cam 8, the follower 14 engaging the cam surface 8*a* of the cam 8 swings around the axis of the rod 152 since the follower 14 is carried by the bell crank 151 fixed to the rod 152. This swinging movement of the follower 14 causes corresponding swinging movement of the lever 153 around the axis of the rod 152. Consequently, the breaker plate 11 is rotated around the axis of the rotary shaft 3, and the position of the movable contact relative to the lobed outer periphery of the cam 10 is changed to provide a corresponding change of the ignition timing.

When the value of the intake manifold vacuum admitted into the diaphragm actuator 19 is increased, the rod 172 connected to the diaphragm in the diaphragm actuator 19 is urged in a direction as shown by the arrow B in FIG. 2 to cause corresponding swinging movement of the lever 171 around the pin 173 in a direction as shown by the arrow C in FIG. 2. The sleeve 7 is rotated around the axis of the rotary shaft 3 to cause rotation of the cam 8 by the corresponding amount around the axis of the rotary shaft 3. As a result, the position of engagement of the follower 14 with the cam surface 8*a* of the cam 8 is changed correspondingly, and the bell crank 151 carrying the follower 14 acts to cause corresponding rotation of the rod 152. Therefore, the lever 153 fixed to this rod 152 causes corresponding rotation of the breaker plate 11 around the axis of the rotary shaft 3 to change the ignition timing accordingly.

In the embodiment of the present invention shown in FIGS. 1 and 2, the diaphragm actuator 19 of known structure is used as a means for causing rotation of the sleeve 7 thereby advancing the ignition timing. However, those skilled in the art will easily understand that any desired ignition timing retarding motion can be imparted to the breaker plate 11 in addition to the advancing motion when the curved configuration of the cam surface 8*a* of the cam 8 is suitably designed, and the resilient strength of the diaphragm spring in the diaphragm actuator 19 and that of the spring 20 acting upon the sleeve 7 are suitably determined.

The distributor according to the present invention is also equally effectively applicable to a spark ignition engine of the kind in which the output is controlled depending on the fuel-air ratio. In such a case, the second link mechanism 17 connected to the sleeve 7 may be directly connected to an accelerating rod (not shown) connected to the accelerator pedal. Thus, in this case, the sleeve 7 is rotated by an angle corresponding to the depression of the accelerator pedal.

Further, a diaphragm actuator of the type having an ignition advancing chamber and an ignition retarding chamber may be connected to the rod 172 in the link mechanism 17. In this case, the ignition timing can be more finely advanced and retarded than when the known diaphragm actuator having solely the ignition advancing chamber is employed, and the design of the cam surface 8*a* of the cam 8 can be more simplified.

It will be understood from the foregoing description that application of the distributor of the present invention to spark ignition engines designed especially for the control of engine exhaust gases is advantageous in that the powering performance of the engines can be improved while retaining the exhaust gas control performance thereof.

What is claimed is:

1. A distributor for an internal combustion engine having a first rotary shaft, comprising:

a. a fixed cylindrical housing;

b. a second rotary shaft extending into said housing for rotation in synchronism with the first rotary shaft;

c. a breaker plate rotatably supported within said housing and rotatable relative to said second rotary shaft;

d. a swinging arm mounted on said breaker plate and carrying a movable contact;

e. a stationary contact fixedly mounted on said breaker plate and cooperating with said movable contact;

f. a first contact breaker cam fixedly mounted on said second rotary shaft, said movable contact continuously engaging said first cam;

g. a sleeve loosely mounted on said second rotary shaft;

h. a second ignition timing changing cam loosely fitted on said sleeve, said second cam being rotatable around the axis of said second rotary shaft together with said sleeve and movable in the axial direction of said second rotary shaft relative to said sleeve, said second cam having an outer peripheral cam surface in the form of a curved surface of a predetermined order;

i. a follower engaging said cam surface;

j. first link means responsive to the movement of said follower for causing corresponding rotation of said breaker plate around the axis of said second rotary shaft;

k. speed sensing means mounted on said second rotary shaft for urging said second cam in the axial direction of said second rotary shaft upon an increase in the rotating speed of said second rotary shaft; and l. second link means connected to said sleeve for causing rotation of said second cam around the axis of said second rotary shaft through said sleeve in response to the magnitude of the load on the engine.

2. A distributor according to claim 1 further comprising means for detecting the magnitude of the load on the engine, said second link means being urged by said detecting means to cause rotation of said second cam.

3. A distributor according to claim 1 wherein said curved surface is three dimensional.

4. A distributor according to claim 1 further comprising an engine cylinder block, said housing being fixed to said cylinder block.

5. A distributor according to claim 1 further comprising an engine shaft, said cam shaft constituting said first rotary shaft.

6. A distributor according to claim 1 further comprising an engine crankshaft, said crankshaft constituting said first rotary shaft.

7. A distributor according to claim 1 wherein said first link means comprises a bell crank mounting at one end said follower, a first rod rotatably journaled to said housing and having one end fixed to the other end of said bell crank, and a first lever having one end fixed to the other end of said rod, the other end of said lever being pivoted to said breaker plate.

8. A distributor according to claim 7 wherein said second link means comprises a second lever having one end coupled to said sleeve, said second lever being pivoted at an intermediate portion to said housing, and a second rod pivoted at one end to the other end of said second lever, said second rod being axially movable to rotate said second lever, the other end of said second rod being connectable to a means to move said second rod in response to the magnitude of the load on the engine.

9. A distributor according to claim 8 wherein said speed sensing means comprises a pair of centrifugal weights swingingly mounted on said second rotary shaft; and further comprising a first spring, connected between said sleeve and said second cam, pressing said cam towards said weights, said weights axially moving said cam against said spring when the rotating speed of said second rotary shaft increases.

10. A distributor according to claim 9 further comprising a second spring connected between said housing and said sleeve to maintain the ignition timing constant when the engine is not accelerated.

* * * * *